US006302217B1

(12) United States Patent
Kilgore et al.

(10) Patent No.: US 6,302,217 B1
(45) Date of Patent: Oct. 16, 2001

(54) EXTREME SERVICE PACKER HAVING SLIP ACTUATED DEBRIS BARRIER

(75) Inventors: Marion D. Kilgore, Dallas; Robert L. Hilts, Carrollton, both of TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/250,931

(22) Filed: Feb. 18, 1999

Related U.S. Application Data

(63) Continuation-in-part of application No. 09/004,394, filed on Jan. 8, 1998, now Pat. No. 6,112,811.

(51) Int. Cl.[7] ..... E21B 23/06; E21B 33/12; E21B 33/129

(52) U.S. Cl. ..... 166/382; 166/134; 166/206

(58) Field of Search ..... 166/134, 382, 166/206

(56) References Cited

U.S. PATENT DOCUMENTS

| | | | | |
|---|---|---|---|---|
| 2,714,931 | * | 8/1955 | Bouvier | 166/134 X |
| 3,062,291 | * | 11/1962 | Brown | 166/134 X |
| 3,142,338 | * | 7/1964 | Brown | 166/134 X |
| 3,181,614 | * | 5/1965 | Brown | 166/134 X |
| 3,265,132 | * | 8/1966 | Edwards, Jr. | 166/134 X |
| 3,282,342 | * | 11/1966 | Mott | 166/134 X |
| 3,695,352 | * | 10/1972 | McGill | 166/134 X |
| 4,018,272 | * | 4/1977 | Brown et al. | 166/119 |
| 4,754,814 | * | 7/1988 | Jordan, Jr. | 166/134 X |
| 4,903,777 | * | 2/1990 | Jordan, Jr. et al. | 166/134 X |
| 5,701,954 | | 12/1997 | Kilgore et al. . | |
| 5,839,515 | * | 11/1998 | Yuan et al. | 166/134 X |

FOREIGN PATENT DOCUMENTS

| | | |
|---|---|---|
| 0794316A2 | 9/1997 | (EP) . |
| 0928879A | 7/1999 | (EP) . |

* cited by examiner

*Primary Examiner*—David Bagnell
*Assistant Examiner*—Sunil Singh
(74) *Attorney, Agent, or Firm*—Paul I. Herman; Marlin R. Smith

(57) ABSTRACT

Apparatus and methods are provided for anchoring within tubular structures and releasing therefrom. In a described embodiment, a packer includes multiple debris barriers, which are deployed when slips of the packer are radially outwardly extended. The debris barriers prevent debris from settling about the slips, thereby enhancing convenient retrieval of the packer. Use of the debris barriers may also permit control over how the slips are extended.

30 Claims, 13 Drawing Sheets

EXTREME SERVICE PACKER HAVING SLIP ACTUATED DEBRIS BARRIER

CROSS-REFERENCE TO RELATED APPLICATION

This application is a continuation in part of Ser. No. 09/004,394, filed Jan. 8, 1998, now U.S. Pat. No. 6,112,811, issued Sep. 5, 2000, the disclosure of which is incorporated herein by this reference.

BACKGROUND OF THE INVENTION

The present invention relates generally to anchoring apparatus utilized in subterranean wells and, in an embodiment described herein, more particularly provides a packer for use in extreme service conditions.

In a typical packer having a single slip, which may consist of a single slip member or multiple circumferentially distributed slip segments, forces applied to the packer are necessarily resisted by the same slip. Thus, when a downwardly directed tubing load and a downwardly directed differential pressure are applied to the packer, the single slip must resist both by its gripping engagement with a tubular structure (such as casing, tubing, other equipment, etc.) in which it is set. In extreme service conditions, the slip may need to be radially outwardly forced into contact with the tubular structure, in order to resist the forces applied to the packer, with enough force to cause damage to the tubular structure, the packer, or both.

If the gripping surface area on the slip is increased in an attempt to increase the gripping engagement between the slip and the tubular structure, it has been found that it is more difficult for the slip to initially bite into the tubular structure. This is due to the fact that more of the slip is required to deform more of the tubular structure. Consequently, more radially outwardly directed force must be applied to the slip, thereby causing damage to the tubular structure.

It would be advantageous to be able to use multiple axially spaced apart slips on an anchoring device, in order to distribute forces applied to the device among the slips. In addition, it would be advantageous for each of the multiple slips to be dual slips, so that each of the slips could resist forces applied thereto in both axial directions. Unfortunately, the use of multiple axially spaced apart slips presents additional problems, particularly when the slips are dual slips.

For example, it may be difficult to retrieve the anchoring device after the slips have been grippingly engaged with the tubular structure. This is due to the fact that slips generally have inclined teeth, serrations, etc. formed thereon which, when axially opposed with other slips, resist disengagement from the tubular structure.

As another example, mechanisms to extend and then retract multiple slips may be prohibitively complex, and therefore unreliable, uneconomical and/or too delicate for use in extreme service conditions. Thus, an extreme service anchoring apparatus utilizing multiple axially spaced apart slips should include appropriately robust, economical and reliable mechanisms for extending the slips and, where the apparatus is to be made retrievable, should include a retracting mechanism with similar qualities.

To further enable convenient retrieval of an anchoring apparatus, debris which accumulates about the apparatus should be minimized. Such accumulation of debris may be eliminated or lessened by providing an appropriately configured debris barrier. However, deployment of the debris barrier should not require complex mechanisms or procedures, and should not interfere with anchoring the apparatus. Additionally, deployment of the debris barrier or barriers may be useful in controlling anchoring of the apparatus.

From the foregoing, it can be seen that it would be quite desirable to provide an anchoring apparatus in which one or more debris barriers may be conveniently deployed. It is accordingly an object of the present invention to provide conveniently deployable debris barriers for an anchoring apparatus. It is another object of the present invention to provide debris barriers which may control or enhance setting of the apparatus. It is a still further object of the present invention to provide methods of producing a slip for an anchoring apparatus, the slip being configured for convenient use with a debris barrier.

SUMMARY OF THE INVENTION

In carrying out the principles of the present invention, in accordance with an embodiment thereof, a packer is provided which uses one or more debris barriers to reduce debris accumulation about the packer. The packer is reliable, retrievable, economical and convenient in operation. Associated methods are also provided.

In one aspect of the present invention, apparatus is provided which includes multiple debris barriers positioned relative to a slip, such that the slip is substantially between the debris barriers when the slip is radially outwardly extended. In one described embodiment, the slip pushes the debris barriers up sloped outer surfaces of wedge members, thereby radially outwardly extending the debris barriers.

In another aspect of the present invention, each debris barrier is disposed in a recess. The slip pushes the debris barriers out of the recesses when the slip is radially outwardly extended. In one described embodiment, the recesses are configured so that one of the debris barriers is pushed out of its recess before another one of the debris barriers. This enables the setting action of the slip to be controlled.

In another aspect of the present invention, radially extendable debris barriers are provided on the apparatus and disposed above and below the upper slip. The debris barriers are positioned on laterally inclined outer side surfaces of wedges associated with the upper slip. When the upper slip is radially outwardly extended by the wedges, axial displacement of the slip relative to the wedges causes the debris barriers to radially outwardly extend as well. At least the upper one of the debris barriers closes off an annular gap between the upper wedge and the tubular structure in which the apparatus is set, thereby excluding debris from accumulating about the apparatus and enhancing retrieval of the apparatus.

In yet another aspect of the present invention, methods of producing a slip are provided. The slip has relatively narrow slots, which enhance the slip's ability to support a debris barrier. In one embodiment, the slots are cut using an abrasive water jet. In another embodiment, the slots are cut with the slip immersed in a liquid.

The exemplary embodiment of the invention described below is in a packer specifically designed for use in extreme service conditions. However, the principles of the present invention may be readily utilized in other equipment, such as plugs, hangers, etc.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1A:
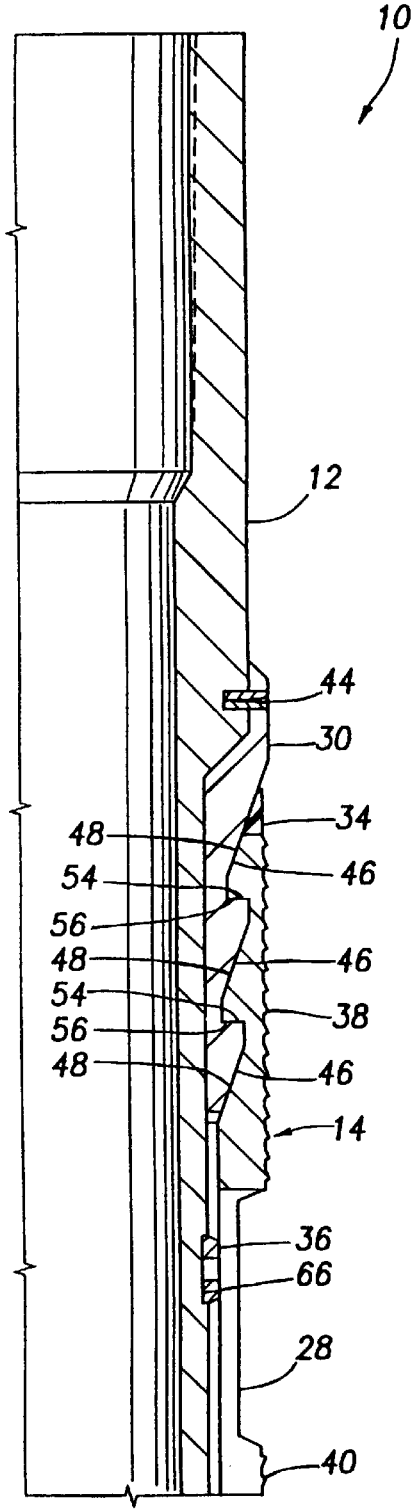
FIGS. 1A–1F are quarter-sectional views of successive axial sections of a first apparatus embodying principles of the present invention, the apparatus being shown in a configuration in which it is run into a subterranean well.

Representatively illustrated in FIGS. 1A–1F is a packer 10 which embodies principles of the present invention. In the following description of the packer 10 and methods described herein, directional terms, such as "above", "below", "upper", "lower", etc., are used for convenience in referring to the accompanying drawings. Additionally, it is to be understood that the embodiment of the present invention described herein may be utilized in various orientations, such as inclined, inverted, horizontal, vertical, etc., without departing from the principles of the present invention.

The packer 10 includes an inner generally tubular mandrel 12, which is internally threaded at its upper end for attachment to a tubular string (not shown in FIGS. 1A–1F) in a conventional manner. Loads may be transmitted to the mandrel 12 from the tubular string in each axial direction. For example, an axially downwardly directed load may be applied to the mandrel 12 by the weight of the tubular string. An axially upwardly directed load may be applied to the mandrel 12 by axial contraction of the tubular string, such as when relatively cool injection fluids are pumped through the tubular string. Many other situations may also result in loads being applied to the mandrel 12.

For resisting these loads and other forces applied to the packer 10, the packer includes an upper slip assembly 14 and a lower slip assembly 16. The packer 10 also includes a seal assembly 18, an axially compressible assembly or release device 20, a hydraulic setting assembly 22, an internal slip assembly 24, and a retrieval mechanism 26.

The upper slip assembly 14 includes a dual barrel slip 28, an upper wedge 30, a lower wedge 32, a debris barrier 34, and a generally C-shaped snap ring 36 disposed in an annular recess 66 formed on the mandrel 12. The slip 28 is of the dual type, meaning that it is configured for resisting forces applied thereto in both axial directions. For this purpose, teeth or other gripping structures 38 on the slip 28 are oppositely oriented relative to other teeth or other gripping structures 40 on the slip. In the representatively illustrated slip 28, the teeth 38, 40 are formed directly on the slip, which is a circumferentially continuous axially slotted barrel slip of the type well known to those of ordinary skill in the art. The lower slip assembly 16 includes a similar slip 42. However, it is to be clearly understood that the slips 28, 42, or either of them, may be differently configured without departing from the principles of the present invention. For example, the teeth 38, 40 or other gripping structures may be separately attached to the remainder of the slip, the slips 28, 42 may be C-shaped, or otherwise circumferentially discontinuous, the slips may be circumferentially divided into slip segments, etc.

The upper wedge 30 is releasably secured to the mandrel 12 with a pin 44 installed through the wedge and into the mandrel. Multiple generally conical downwardly facing outer side surfaces 46 formed on the wedge 30 engage complementarily shaped inner side surfaces 48 formed on the slip 28, so that when the slip is displaced axially upward relative to the wedge, in a manner described more fully below, the slip is radially outwardly displaced relative to the mandrel 12. The lower wedge 32 similarly has multiple generally conical upwardly facing outer side surfaces 50 formed thereon, and the slip 28 has complementarily shaped inner side surfaces 52 formed thereon, for radially outwardly displacing the slip. Additionally, the wedges 30, 32 and slip 28 have inclined surfaces 54, 56 formed thereon, respectively, to prevent axial separation therebetween, and to aid in radially inwardly retracting the slips when the packer 10 is retrieved, as described more fully below.

The lower slip assembly 16 is generally similar to the upper slip assembly 14. The lower slip assembly 16 includes the slip 42, an upper wedge 58 releasably secured against displacement relative to the mandrel 12 by a pin 60, a lower wedge 62, and a snap ring 64 disposed in an annular recess 68 formed on the mandrel 12. The slip 42 and wedges 58, 62 have the corresponding surfaces 46, 48, 50, 52, 54, 56 formed thereon, albeit oppositely oriented as compared to the upper slip assembly 14.

The seal assembly 18 includes multiple circumferential seal elements 70 of conventional design carried about the mandrel 12. Of course, more or less of the seal elements 70 or differently configured seal elements may be utilized in a packer or other apparatus constructed in accordance with the principles of the present invention. The seal elements 70 are axially straddled by backup shoes 72. The seal elements 70 are radially outwardly extendable relative to the mandrel 12 by axially compressing them between an upper generally tubular element retainer 74 and a lower generally tubular element retainer 76.

The setting assembly 22 includes a lower portion of the lower element retainer 76 which carries internal seals 78 thereon for sealing engagement with the mandrel 12, and which carries external seals 80 thereon and is threadedly attached to an outer tubular housing 82. A difference in diameters between the seals 78, 80 forms an annular piston or differential piston area on the element retainer 76. Another annular piston 84 is sealingly engaged radially between the housing 82 and the mandrel 12, and is disposed axially between a snap ring 86 and an upper tubular portion of the wedge 58.

An opening 88 formed radially through the mandrel 12 permits fluid communication between the interior of the mandrel and an annular chamber 90 formed radially between the mandrel and the housing 82, and axially between the element retainer 76 and the annular piston 84. A predetermined fluid pressure differential is applied to the interior of the mandrel 12 (e.g., via the tubular string connected thereto and extending to the earth's surface) and thus to the chamber 90 to set the packer 10, as will be more fully described below.

The internal slip assembly 24 includes a slip member 92 disposed radially between the housing 82 and the upper tubular portion of the wedge 58. The slip member 92 is engaged with the housing 82 by means of relatively coarse teeth or buttress-type threads 94, and the slip member is engaged with the upper tubular portion of the wedge 58 by means of relatively fine teeth or buttress-type threads 96. The teeth or threads 94, 96 are inclined, so that the slip member 92 permits the wedge 58 to displace axially downward relative to the housing 82, but prevents axially upward displacement of the wedge 58 relative to the housing.

A shear screw 98 installed laterally through a generally tubular retainer 100 threadedly attached to the housing 82, and into a recess 102 formed externally on the wedge 58 releasably secures the housing against displacement relative to the wedge 58. A circumferential wave spring 104 compressed axially between the slip member 92 and the retainer 100 maintains an axially upwardly directed force on the slip member, so that the slip member is maintained in engagement with both the housing 82 and the wedge 58. A pin 106 is installed through the housing 82 and into an axial slot formed through the slip member 92, to prevent rotation of the slip member.

Figure 1B:
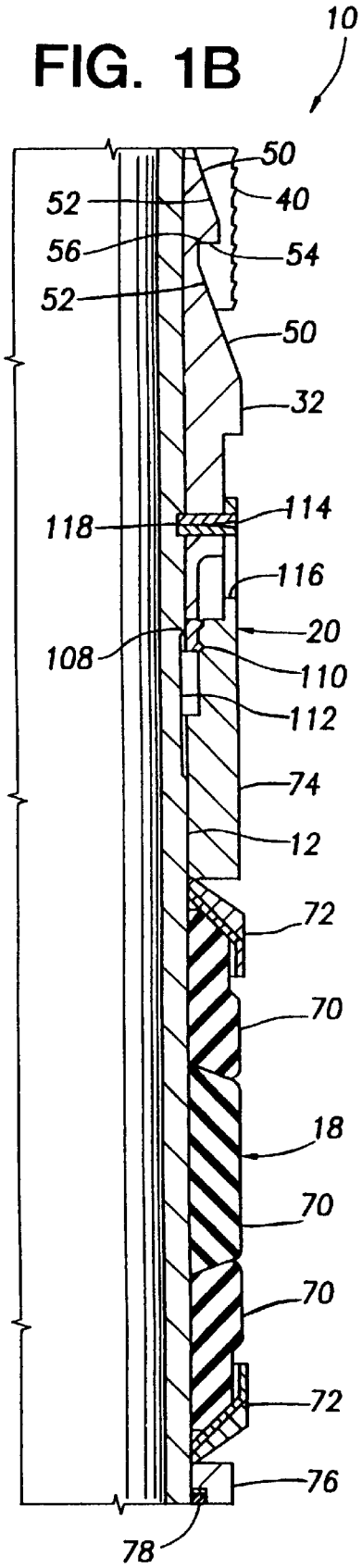
Figure 1C:
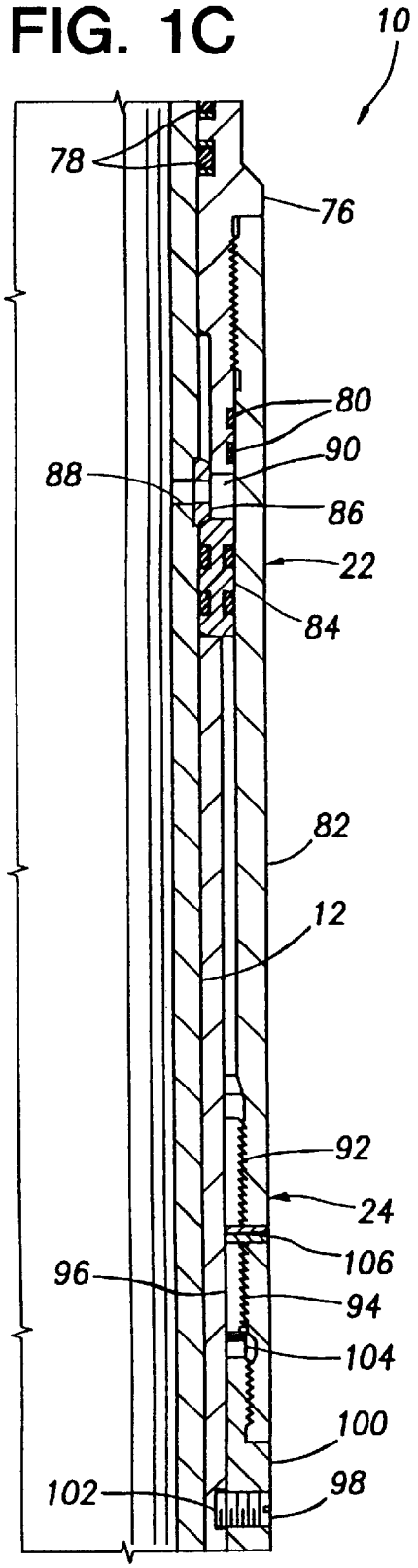
Figure 1D:
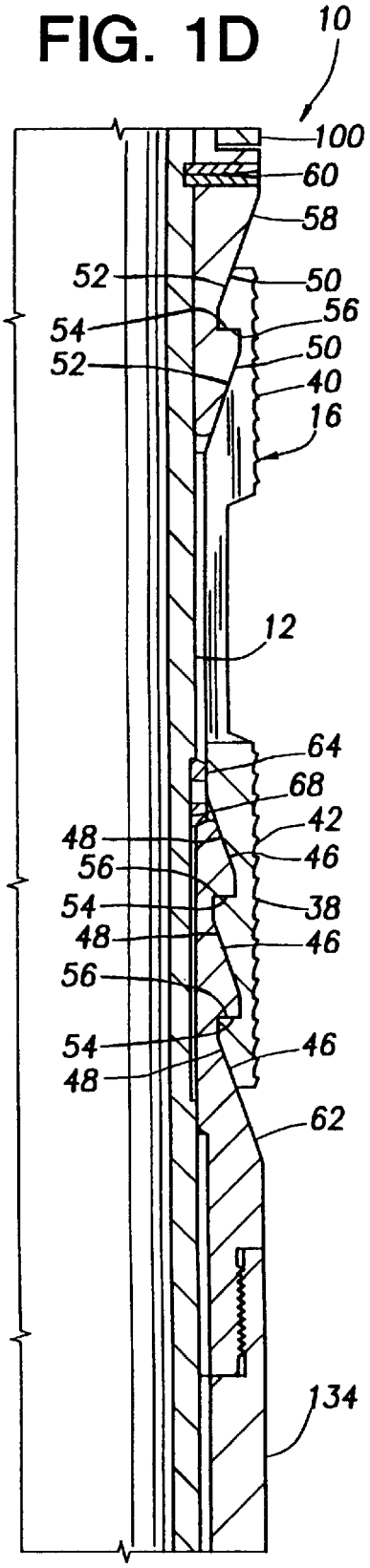
Figure 1E:
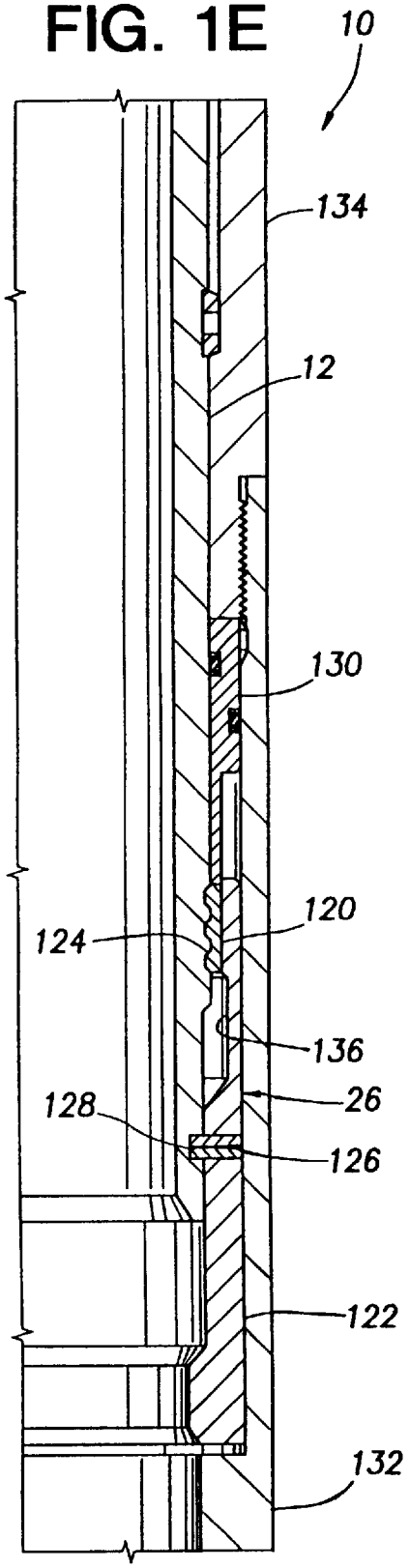
Figure 1F:
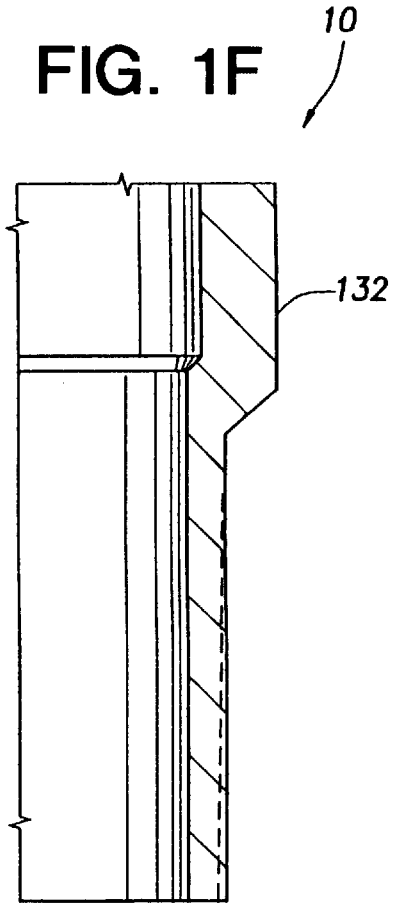
Figure 2A:
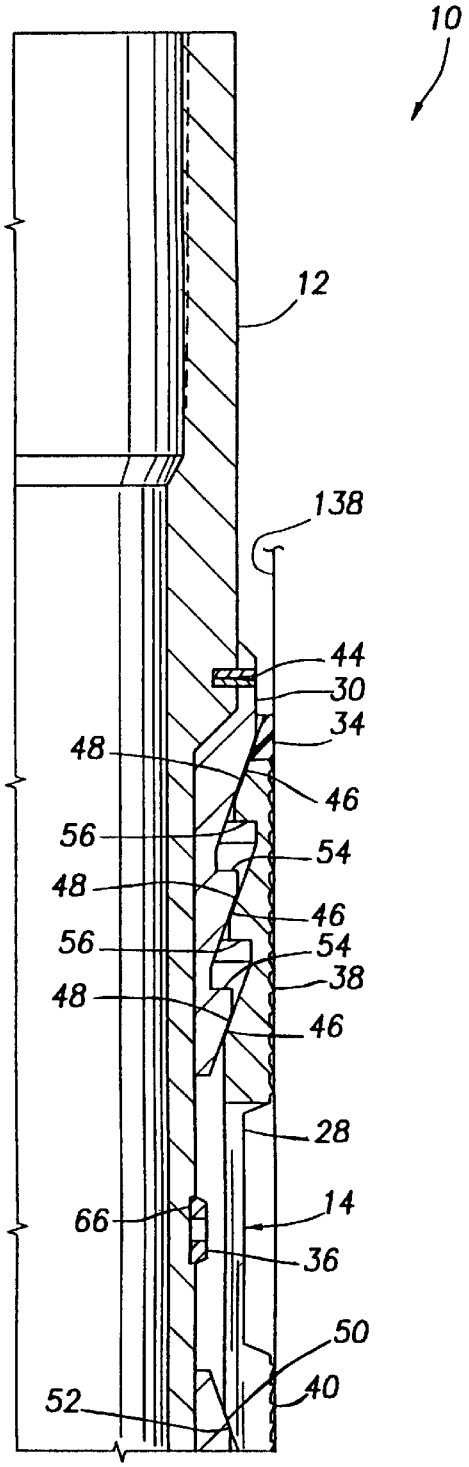
FIGS. 2A–2F are quarter-sectional views of successive axial sections of the first apparatus, the apparatus being shown in a configuration in which it is set within a tubular structure in the well.
Figure 2B:
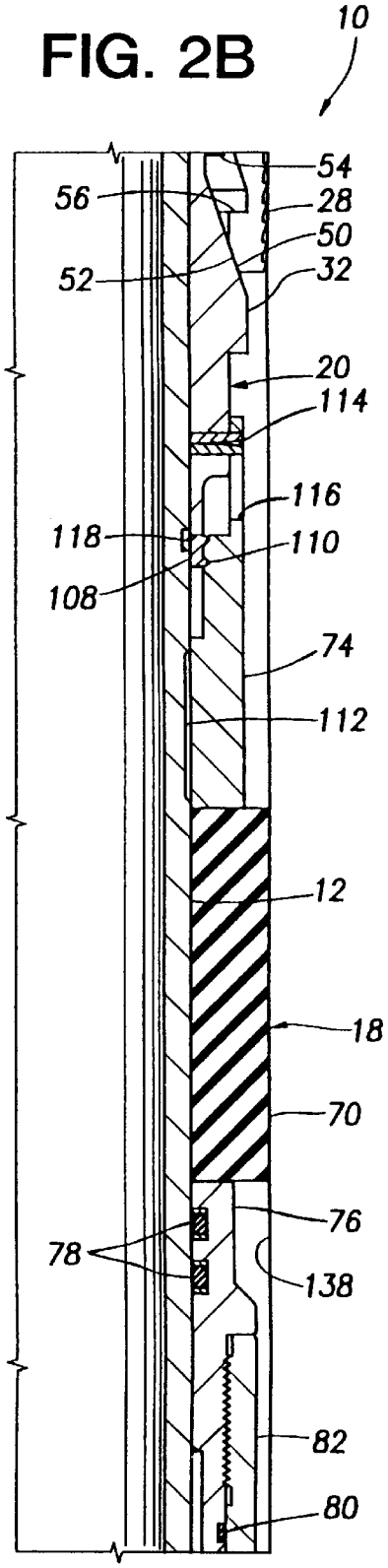
Figure 2C:
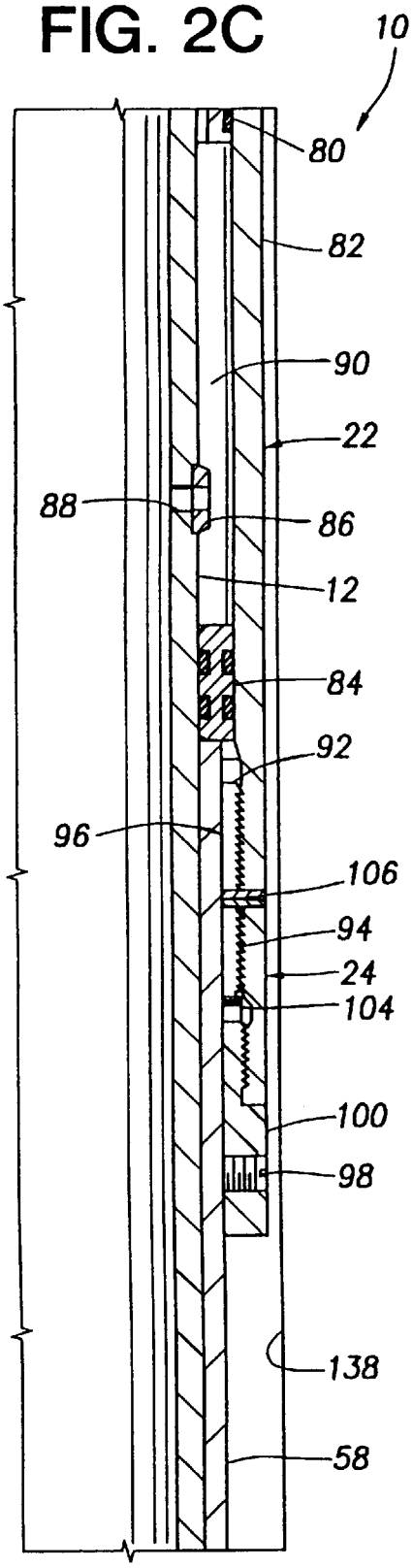
Figure 2D:
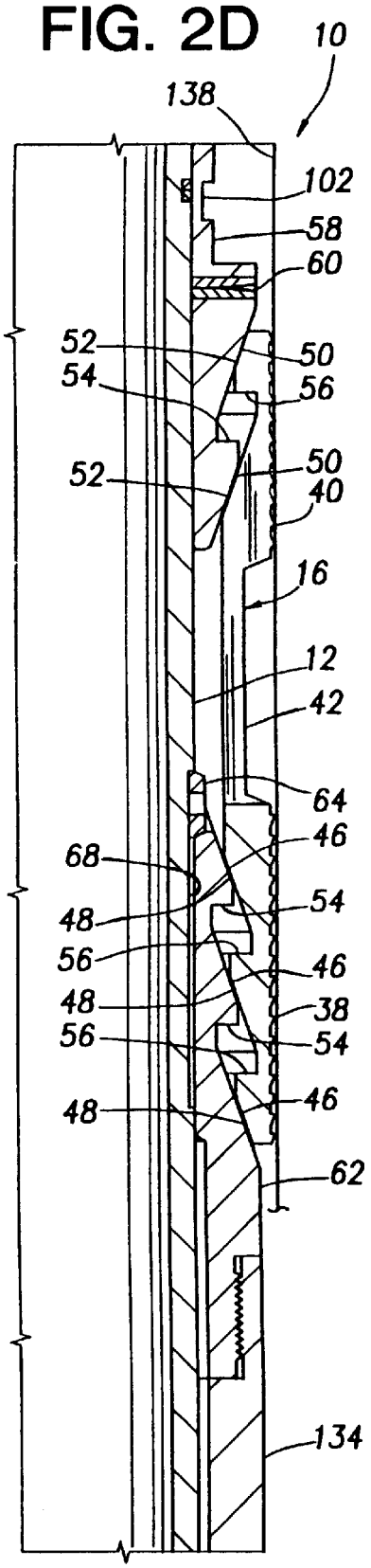
Figure 2E:
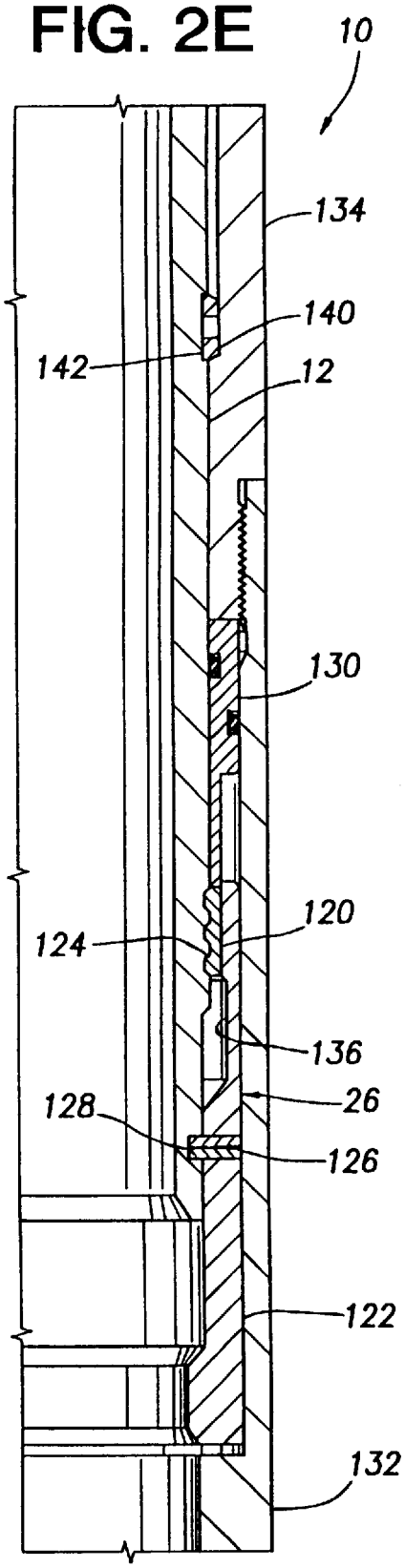
Figure 2F:
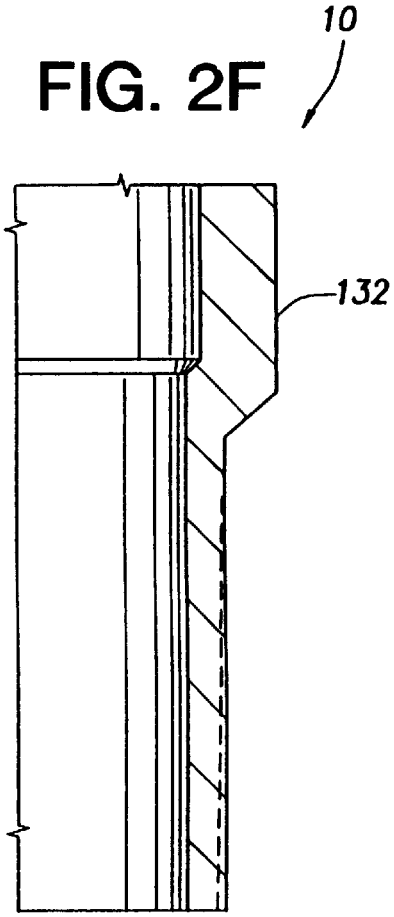
Figure 3A:
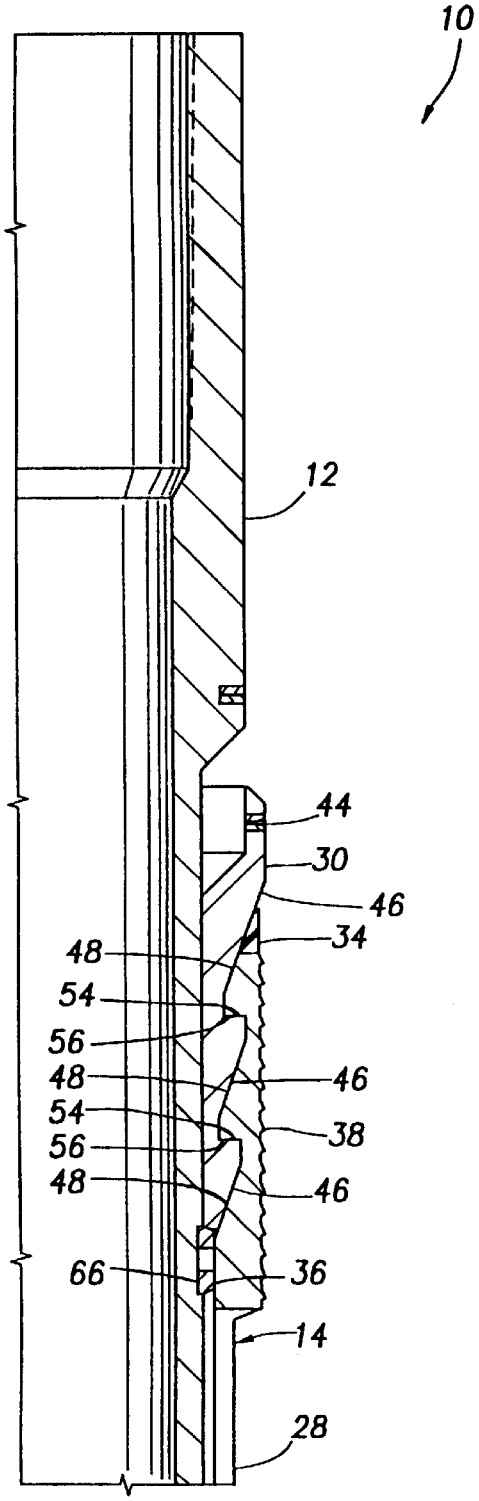
FIGS. 3A–3F are quarter-sectional views of successive axial sections of the first apparatus, the apparatus being shown in a configuration in which it is retrieved from the well.
Figure 3B:
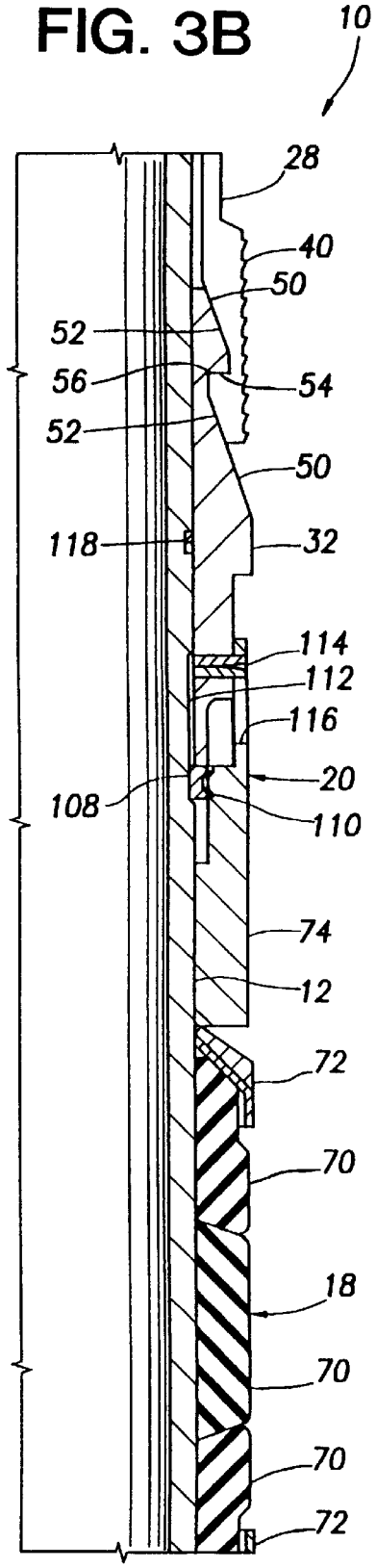
Figure 3C:
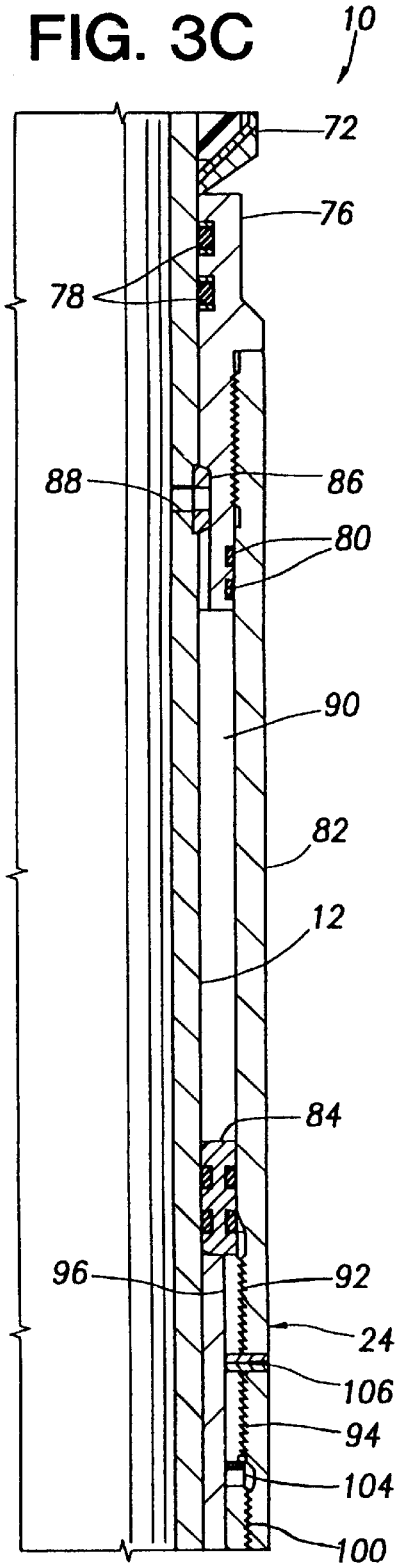
Figure 3D:
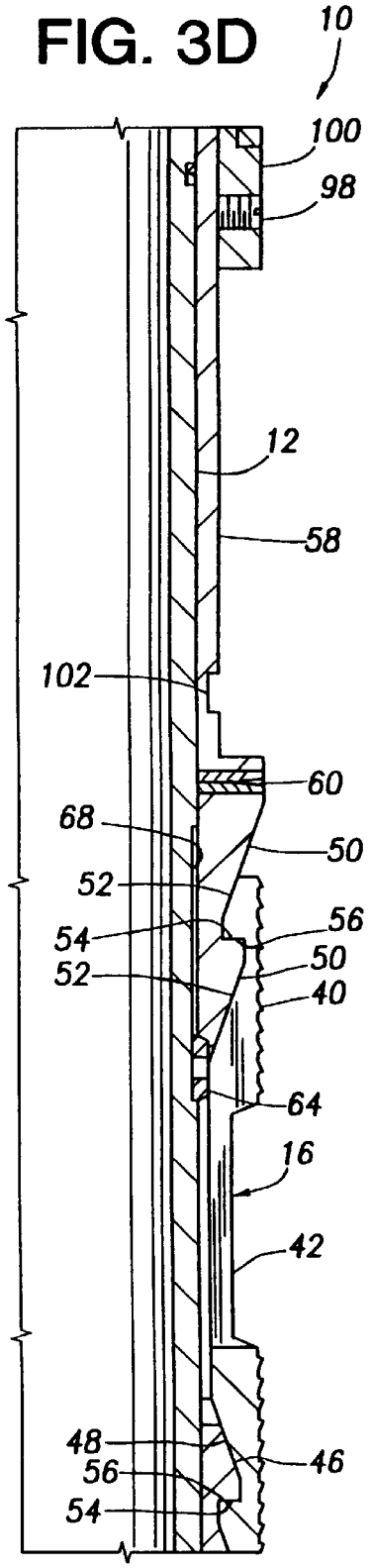
Figure 3E:
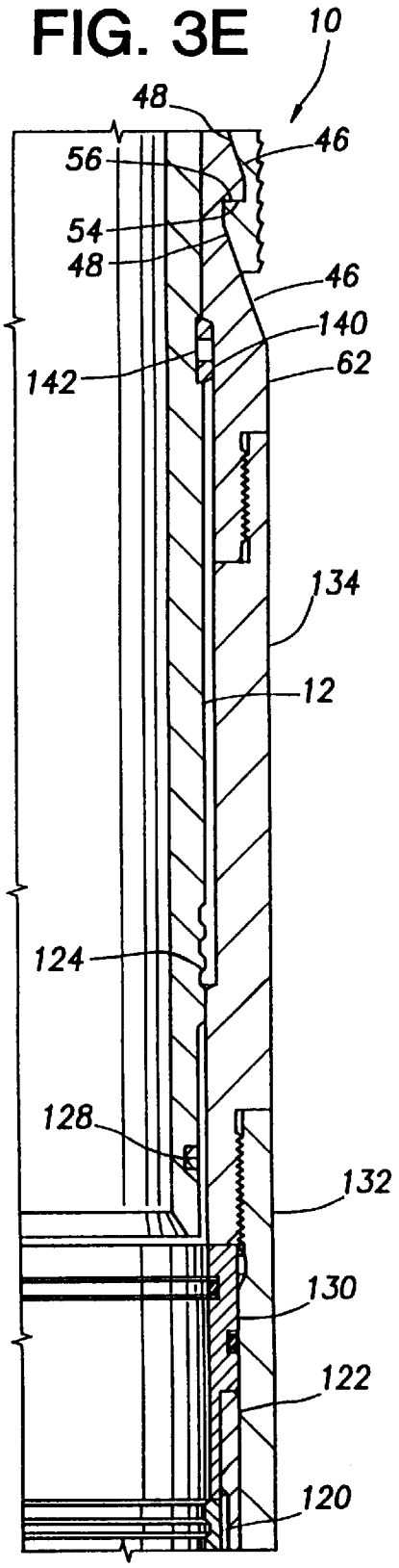
Figure 3F:
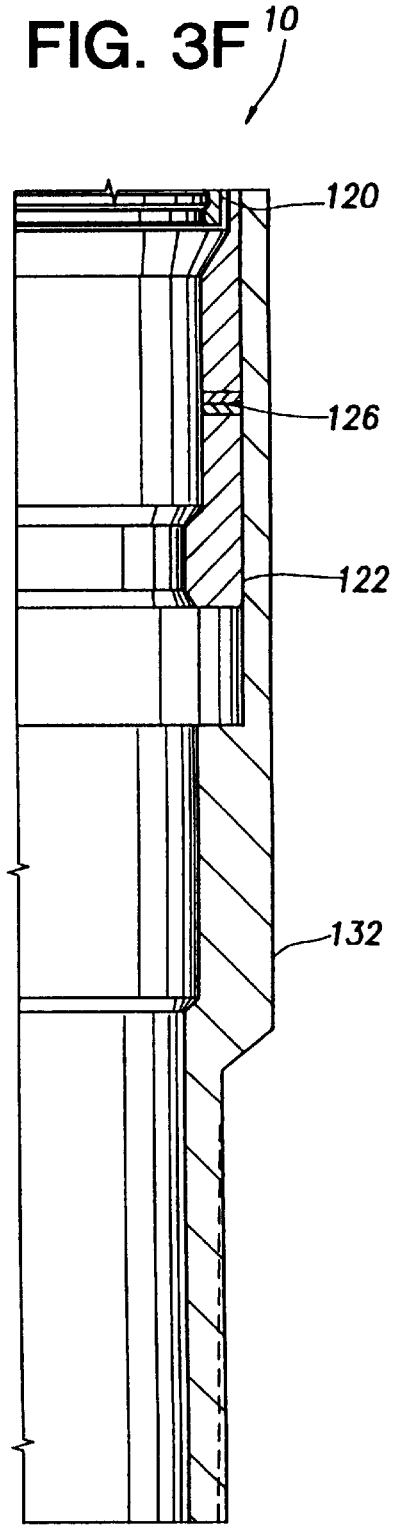

The release device 20 includes an upper portion of the element retainer 74, which is axially telescopingly engaged with a lower portion of the wedge 32. A generally C-shaped snap ring 108 engages a profile 110 formed internally on the element retainer 74, and abuts the lower end of the wedge 32. Thus, as shown in FIG. 1B, the ring 108 prevents axial compression of the release device 20. However, when the mandrel 12 is axially upwardly displaced relative to the ring 108, permitting the ring to radially inwardly retract into an annular recess 112 formed externally on the mandrel, the release device is permitted to axially compress, thereby relieving axial compression of the seal assembly 18 in a manner more fully described below.

A pin 114 is installed through an axially elongated slot 116 formed through the element retainer 74, through the wedge 32, and into a recess 118 formed on the mandrel 12. The pin 114 releasably secures the wedge 32 relative to the mandrel 12, and prevents axial separation of the element retainer 74 and wedge 32, while still permitting the wedge and element retainer to displace axially toward each other.

The retrieval mechanism 26 permits the packer 10 to be conveniently retrieved from the tubular structure in which it is set. It includes a generally C-shaped snap ring 120 disposed radially between the mandrel 12 and a generally tubular support sleeve 122. The support sleeve 122 maintains the ring 120 in engagement with a profile 124 formed externally on the mandrel 12. A pin 126 installed through the sleeve 122 and into a recess 128 formed externally on the mandrel 12 releasably secures the sleeve against displacement relative to the mandrel, thereby securing the ring 120 against disengagement from the profile 124.

An abutment member 130 is sealingly engaged radially between the mandrel 12 and a generally tubular lower housing 132 threadedly attached to a generally tubular intermediate housing 134, which is threadedly attached to a lower end of the wedge 62. The abutment member 130 is disposed axially between a lower end of the housing 134 and the ring 120, thereby preventing axially upward displacement of the ring relative to the housing 134. The lower housing 132 is provided with threads for attachment to a tubular string therebelow (not shown in FIG. 1F).

When it is desired to retrieve the packer 10, the sleeve 122 is shifted axially upward relative to the mandrel 12, thereby shearing the pin 126 and permitting the ring 120 to radially outwardly expand into an annular recess 136 formed internally on the sleeve. The ring 120 thus disengages from the profile 124 and permits axial displacement of the mandrel 12 relative to the substantial remainder of the packer 10. As described above, such axially upward displacement of the mandrel 12 also permits the release device 20 to axially contract. The sleeve 122 may be shifted relative to the mandrel 12 by any of a variety of conventional shifting tools (not shown) in a conventional manner.

As representatively illustrated in FIGS. 1A–1F, the packer 10 is in a configuration in which it may be run into a well and positioned within a tubular structure in the well. Specifically, both slips 28, 42 and the seal elements 70 are radially inwardly retracted.

Referring additionally now to FIGS. 2A–2F, the packer 10 is representatively illustrated set within a tubular structure (represented by inner side surface 138). The slips 28, 42 are radially outwardly extended into gripping engagement with the tubular structure 138, and the seal assembly 18 is axially compressed and radially outwardly extended into sealing engagement with the tubular structure. Note that the seal assembly 18 is shown as a single seal element 70 for clarity of illustration, and to demonstrate that alternate configurations of the seal assembly may be utilized without departing from the principles of the present invention.

To set the packer 10, a fluid pressure is applied to the interior of the mandrel 12. This fluid pressure enters the opening 88 and urges the piston 84 downward while urging the lower element retainer 76 upward. When the fluid pressure reaches a predetermined level, the shear screw 98 shears, thereby permitting the wedge 58 to displace axially downward relative to the housing 82. The wedge 58 is prevented from displacing axially upward relative to the housing 82 by the internal slip assembly 24, as described above.

Shearing of the shear screw 98 also permits the housing 82 and element retainer 76 to displace axially upward relative to the mandrel 12. The retainer 76 pushes axially upward on the seal assembly 18, axially compressing and radially outwardly extending the seal element 70. The seal assembly 18 pushes axially upward on the upper retainer 74. The upper retainer 74 is prevented from displacing axially upward relative to the wedge 32 by the ring 108, so the retainer 74 pushes axially upward on the wedge 32 via the ring 108, shearing the pin 114 and permitting axially upward displacement of the wedge relative to the mandrel 12.

Axially upward displacement of the wedge 32 causes the slip 28 to be radially outwardly displaced by cooperative engagement of the surfaces 50, 52, and by cooperative engagement of the surfaces 46, 48. The slip 28 is thus radially outwardly extended by axial displacement of the wedge 32 toward the wedge 30. As the slip 28 is radially outwardly displaced, it also displaces somewhat axially upward relative to the upper wedge 30. This axially upward displacement of the slip 28 causes the debris barrier 34 to be displaced axially upward relative to the inclined generally conical outer side surface 46.

The debris barrier 34 has a generally triangular-shaped cross-section, such that it is complementarily positionable radially between the surface 46 on which it is disposed and the tubular structure 138. In this manner, debris is prevented from falling and accumulating about the slip assembly 14 and seal assembly 18. Such accumulation of debris could possibly prevent ready retraction of the slip 28 when it is desired to retrieve the packer 10. To facilitate its radial expansion, the debris barrier 34 is formed of a suitable deformable material, such as TEFLON® or an elastomer. Of course, the debris barrier 34 may be differently shaped and may be formed of other materials without departing from the principles of the present invention. Note that the debris barrier 34 does not prevent fluid flow radially between the packer 10 and the tubular structure 138, but does close off the annular gap therebetween to debris flow.

In a similar manner to that described above for the upper slip 28, the lower slip 42 is radially outwardly displaced by axial displacement of the wedge 58 toward the wedge 62. Note that the wedge 62 and housing 134 are prevented from displacing axially upward relative to the mandrel 12 by the ring 64 and by another snap ring 140 disposed in a recess 142 formed externally on the mandrel 12.

At this point, it is instructive to examine the unique manner in which different types of forces applied to the packer 10 are distributed among the slips 28, 42. An axially downwardly directed load applied to the mandrel 12 (for example, by the tubular string attached to the upper end of the mandrel, or by the tubular string attached to the lower end of the lower housing 132) is resisted by engagement of the teeth 38 on the upper portion of the upper slip 28 with the tubular structure 138. Conversely, an axially upwardly directed load applied to the mandrel 12 is resisted by engagement of the teeth 38 on the lower portion of the lower slip 42 with the tubular structure 138.

An axially downwardly directed pressure differential applied to the seal assembly 18 is resisted by engagement of the teeth 40 on the upper portion of the lower slip 42 with the tubular structure 138. An axially upwardly directed pressure differential applied to the seal assembly 18 is resisted by engagement of the teeth 40 on the lower portion of the upper slip 28 with the tubular structure 138.

The above described distribution of forces provides unique advantages to the packer 10 in extreme service conditions. Note that the teeth 40 on the lower portion of the upper slip 28 and on the upper portion of the lower slip 42 serve to resist forces resulting from pressure differentials across the seal assembly 18. The teeth 38 on the upper portion of the upper slip 28 and on the lower portion of the lower slip 42 serve to resist forces resulting from loads transmitted to the mandrel 12. Accordingly, the different types of forces are distributed on each slip 28, 42.

Even more beneficial is the fact that, when the forces are combined, that is, when a load is applied to the mandrel 12 in the same direction as a pressure differential applied to the seal assembly 18, these forces are resisted by different ones of the slips 28, 42. For example, a downwardly directed load applied to the mandrel 12 is resisted by the upper slip 28, and a downwardly directed pressure differential applied to the seal assembly 18 is resisted by the lower slip 42. Conversely, an upwardly directed load transmitted to the mandrel 12 is resisted by the lower slip 42, and an upwardly directed pressure differential applied to the seal assembly 18 is resisted by the upper slip 28. Thus, concentrations of loading on the tubular structure 138 are avoided by distributing combined forces among the slips 28, 42, thereby reducing the possibility of damage to the tubular structure and the packer 10.

In the configuration of the packer 10 shown in FIGS. 2A–2F, a compressive force is stored in the seal assembly 18 even after the fluid pressure applied to the interior of the mandrel 12 is relieved, due to the internal slip assembly 24 preventing the wedge 58 and element retainer 76 from displacing axially toward each other. Since the slips 28, 42 are grippingly engaged with the tubular structure 138 axially straddling the seal assembly 18, this stored compressive force corresponds to a tensile force applied to the tubular structure between the slips. It will be readily appreciated that the compressive force stored in the seal assembly 18 prevents disengagement of the slips 28, 42 from the tubular structure, since the seal assembly urges upwardly on the wedge 32 via the release device 20, and urges downwardly on the wedge 58 via the retainer 76, housing 82 and internal slip assembly 24. Or, stated from a different perspective, the tensile force stored in the tubular structure between the slips 28, 42 urges the slips toward their respective wedges 32, 58.

Therefore, in order to conveniently disengage the slips 28, 42 from the tubular structure, the packer 10 includes the retrieval mechanism 26 and the release device 20. The retrieval mechanism 26, when activated, permits axially upward displacement of the mandrel 12 relative to the substantial remainder of the packer 10. The release device 20, upon axially upward displacement of the mandrel 12, releases the stored compressive force from the seal assembly 18 by permitting the seal assembly to axially elongate.

Referring additionally now to FIGS. 3A–3F, the packer 10 is representatively illustrated in a configuration in which it may be retrieved from the tubular structure 138. The sleeve 122 has been shifted upwardly, thereby permitting the ring 120 to disengage from the profile 124. The mandrel 12 has then been displaced axially upward by, for example picking up on the tubular string attached thereto.

Axially upward displacement of the mandrel 12 has permitted the ring 108 to radially inwardly retract into the recess 112, thereby permitting the element retainer 74 to axially upwardly displace relative to the seal assembly 18. As a result, the compressive force in the seal assembly 18 is released, the seal assembly is permitted to axially elongate, and the seal elements 70 are radially inwardly retracted out of engagement with the tubular structure 138 (not shown in FIGS. 3A–3F).

When the compressive force is released from the seal assembly 18, the corresponding tensile force in the tubular structure 138 between the slips 28, 42 is also released. The slips 28, 42 are thus permitted to radially inwardly retract. Note that at this point the inner wedges 32, 58 are not biased axially away from each other, and the slips 28, 42 are not biased axially toward each other.

Further axially upward displacement of the mandrel 12 causes the ring 36 to engage the wedge 30, and the ring 64 to engage the wedge 58. If the slips 28 have not already completely radially inwardly retracted due to their own resiliency, cooperative engagement of the surfaces 54, 56 will cause the slips to retract out of engagement with the tubular structure 138. Such axially upward displacement of the mandrel 12 also causes the ring 86 to engage the element retainer 76, and the ring 140 to engage the wedge 62, ensuring that the remainder of the packer 10 is retrieved.

Note that, if it is not possible to shift the sleeve 122 as described above, the mandrel 12 may still be axially upwardly displaced to retrieve the packer 10 by severing the mandrel axially between the recess 142 and the profile 124. The mandrel 12 may be severed by conventional methods, such as a linear shaped charge, a thermal cutter, or a chemical cutter, etc.

Thus has been described the packer 10 and methods of anchoring and retrieving apparatus within a tubular structure in a subterranean well. The packer 10 is uniquely configured for use in extreme service conditions, such as those in which very large combined forces may be applied to the packer, but it is also usable in other conditions. Additionally, the packer 10 has been described as incorporating, in a single embodiment, many advantageous features of the present invention. However, it is to be understood that these features may be separately incorporated into various embodiments of the present invention.

Figure 4A:
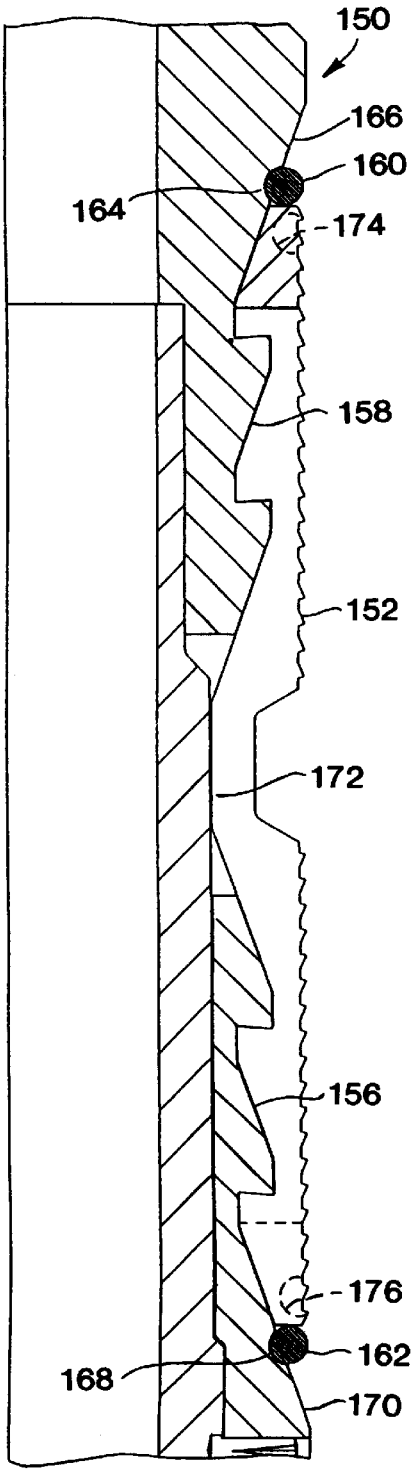
FIGS. 4A&B are quarter-sectional views of an axial section of a second apparatus embodying principles of the present invention, FIG. 4A showing the apparatus in a configuration in which it is run into a subterranean well, and FIG. 4B showing the apparatus in a configuration in which it is set within a tubular structure in the well.

Referring additionally now to FIGS. 4A&B, an axial portion of a packer 150 embodying principles of the present invention is representatively illustrated. The axial portion of the packer 150 shown in FIGS. 4A&B includes an upper dual barrel slip 152 similar in many respects to the upper slip 28 of the packer 10 described above. The remainder of the packer 150 may be similar to the packer 10, or it may be similar to a conventional packer.

Figure 4B:
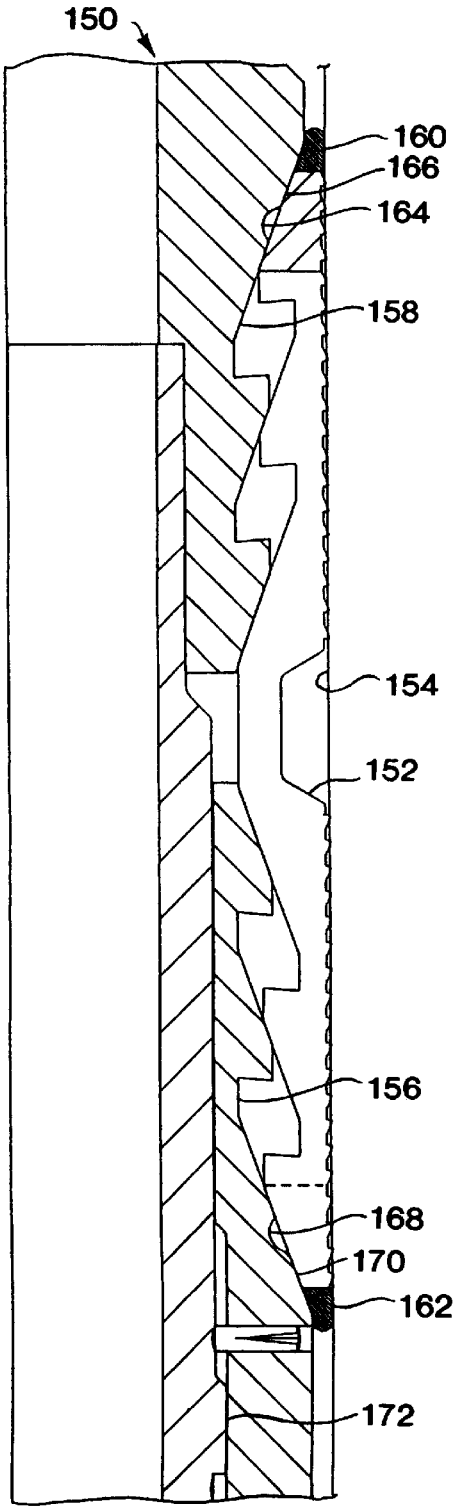

In FIG. 4A, the packer 150 is depicted in a configuration in which it is run into a subterranean well. In FIG. 4B, the packer 150 is depicted as it is set within the well, the slip 152 grippingly engaging an inner side surface 154 of a tubular member, such as casing, tubing, a liner, etc. The slip 152 is radially outwardly extended from the configuration shown in FIG. 4A to the configuration shown in FIG. 4B by displacement of a lower wedge member 156 axially upward toward an upper wedge member 158, similar to the manner in which the slip 28 is radially outwardly extended in the packer 10 described above.

However, note that a circumferential debris barrier 160 is positioned above the slip 152 and a circumferential debris barrier 162 is positioned below the slip. In FIG. 4A, the upper debris barrier 160 is disposed in a circumferential recess 164 formed externally on a sloped or inclined outer side surface 166 formed on the upper wedge 158. Similarly, the lower debris barrier 162 is disposed in a circumferential recess 168 formed externally on a sloped or inclined outer side surface 170 formed on the lower wedge 156.

When the lower wedge 156 is displaced upward relative to the upper wedge 158, the slip 152 pushes each of the debris barriers 160, 162 out of its respective recess 164, 168. Furthermore, the slip 152 pushes each of the debris barriers 160, 162 axially across its respective inclined surface 166, 170, so that the debris barriers are radially outwardly extended as the slip is radially outwardly extended. In FIG. 4B, the debris barriers 160, 162 are shown engaged with the tubular member inner side surface 154, thereby preventing debris accumulation about the slip 152.

Multiple debris barriers 160, 162 may be utilized so that the slip 152 is uniformly extended, that is, with each opposite end of the slip radially outwardly extending at approximately the same time and at approximately the same rate. This ensures substantially uniform gripping engagement of each opposite end of the slip 152 as the packer 150 is set, thus avoiding any undesirable movement of the slip relative to the mandrel 172 as the packer is set.

Note that the debris barriers 160, 162 expand radially outward at a rate greater than the rate at which the slip 152 expands radially outward. This is due to the fact that the debris barriers 160, 162 are pushed out of the recesses 164, 168 by the slip 152, thereby radially expanding the debris barriers, before the debris barriers are pushed across their respective inclined surfaces 166, 170 of the wedges 158, 156. Thus, greater radial compression of the debris barriers 160, 162 against the inner side surface 154 is achieved as compared to the debris barrier 34 described above.

Although the debris barriers 160, 162 are depicted as having generally circular cross-sections, and the recesses 164, 168 are depicted as having generally circular cross-sections, it is to be clearly understood that the debris barriers and/or the recesses may be otherwise shaped without departing from the principles of the present invention. Additionally, the debris barriers 160, 162 may be made of elastomeric material, nonelastomeric material, plastic material, metal, or any other material, without departing from the principles of the present invention.

An alternate placement of the debris barriers 160, 162 may be in circumferential recesses 174, 176 formed externally on the slip 152 and shown in FIG. 4A in dashed lines. The debris barriers 160, 162 might also be positioned on axial extensions of the slip 152 above and below the gripping portion of the slip. It will be readily appreciated that the debris barriers 160, 162 may be otherwise positioned without departing from the principles of the present invention. However, it is preferred, but not required, that at least a substantial portion of the slip 152 be disposed between the debris barriers 160, 162.

Figure 5A:
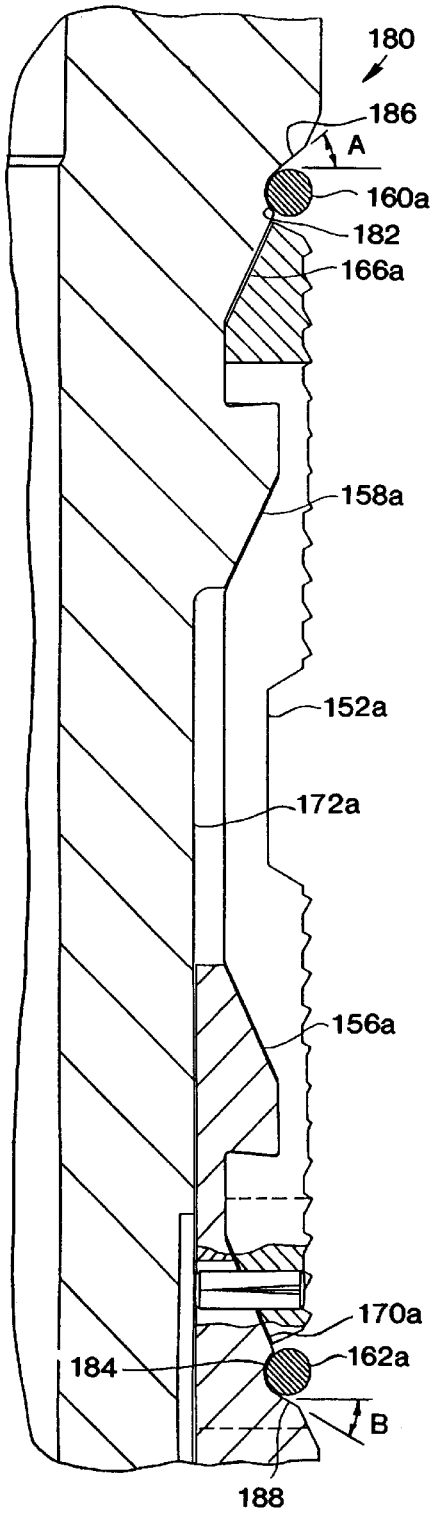
FIGS. 5A&B are quarter-sectional views of an axial section of a third apparatus embodying principles of the present invention, FIG. 5A showing the apparatus in a configuration in which it is run into a subterranean well, and FIG. 5B showing the apparatus in a configuration in which it is set within a tubular structure in the well.
Figure 5B:
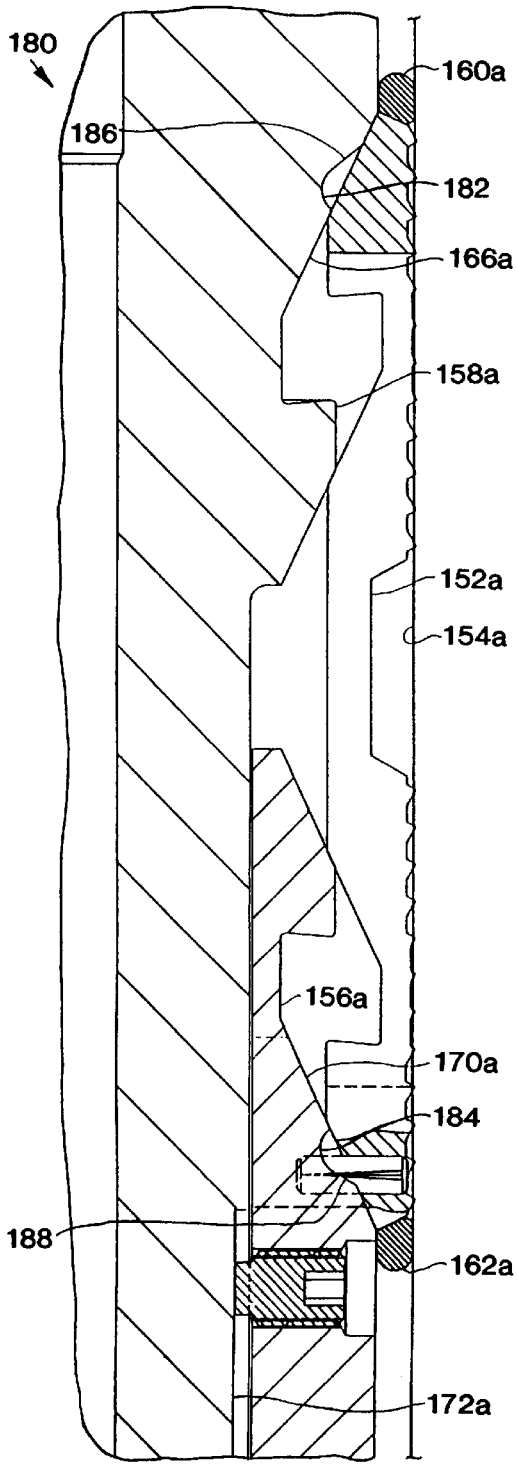

Referring additionally now to FIGS. 5A&B, an axial portion of a packer 180 embodying principles of the present invention is representatively illustrated. The packer 180 is depicted in FIG. 5A in a configuration in which it is run into a subterranean well. The packer 180 is depicted in FIG. 5B in a configuration in which it is set in a tubular member in the well. The packer 180 is similar in many respects to the packer 150 described above and similar elements shown in FIGS. 5A&B are indicated by their same reference numbers, with an added suffix "a".

In the packer 180, circumferential recesses 182, 184 formed externally on the upper and lower wedges 158*a*, 156*a*, respectively, are configured so that one end of the slip 152*a* is radially outwardly extended into gripping engagement with the inner side surface 154*a* before the other end. Thus, the debris barrier configuration may be used to control setting of the slip 152*a*.

An upper peripheral edge surface 186 of the upper recess 182 opposite the slip 152*a* is laterally angled or sloped at an angle A which is different from an angle B at which a lower peripheral edge surface 188 of the lower recess 184 opposite the slip is laterally angled or sloped. As representatively illustrated in FIGS. 5A&B, angle A is greater than angle B, so that it is easier for the slip 152*a* to push the upper debris barrier 160*a* out of the upper recess 182 than it is for the slip to push the lower debris barrier 162*a* out of the lower recess 184. Thus, the upper end of the slip 152*a* will push the upper debris barrier 160*a* out of the upper recess 182 and across the inclined surface 186 before the lower end of the slip will push the lower debris barrier 162*a* out of the lower recess 184 and across the inclined surface 188, resulting in the upper end of the slip grippingly engaging the inner side surface 154*a* before the lower end of the slip. This situation, in which one end of the slip 152*a* engages the inner side surface 154*a* before the other end, may be desirable, for example, to ensure that the end of the slip opposite the displacing wedge 156*a* grips the inner side surface first.

Other methods of deploying one debris barrier before another, or of engaging one end of a slip before another, may be utilized without departing from the principles of the present invention. For example, one of the debris barriers 160*a*, 162*a* may have a strength or a resistance to being expanded which is different from that of the other debris barrier, one of the debris barriers may be positioned differently on its respective wedge 158*a*, 156*a* from the other debris barrier, one end of the slip 152*a* may be configured differently from the other end of the slip, one of the peripheral edge surfaces 186, 188 may have a radius, instead of a slope, different from the other, etc.

Figure 6:
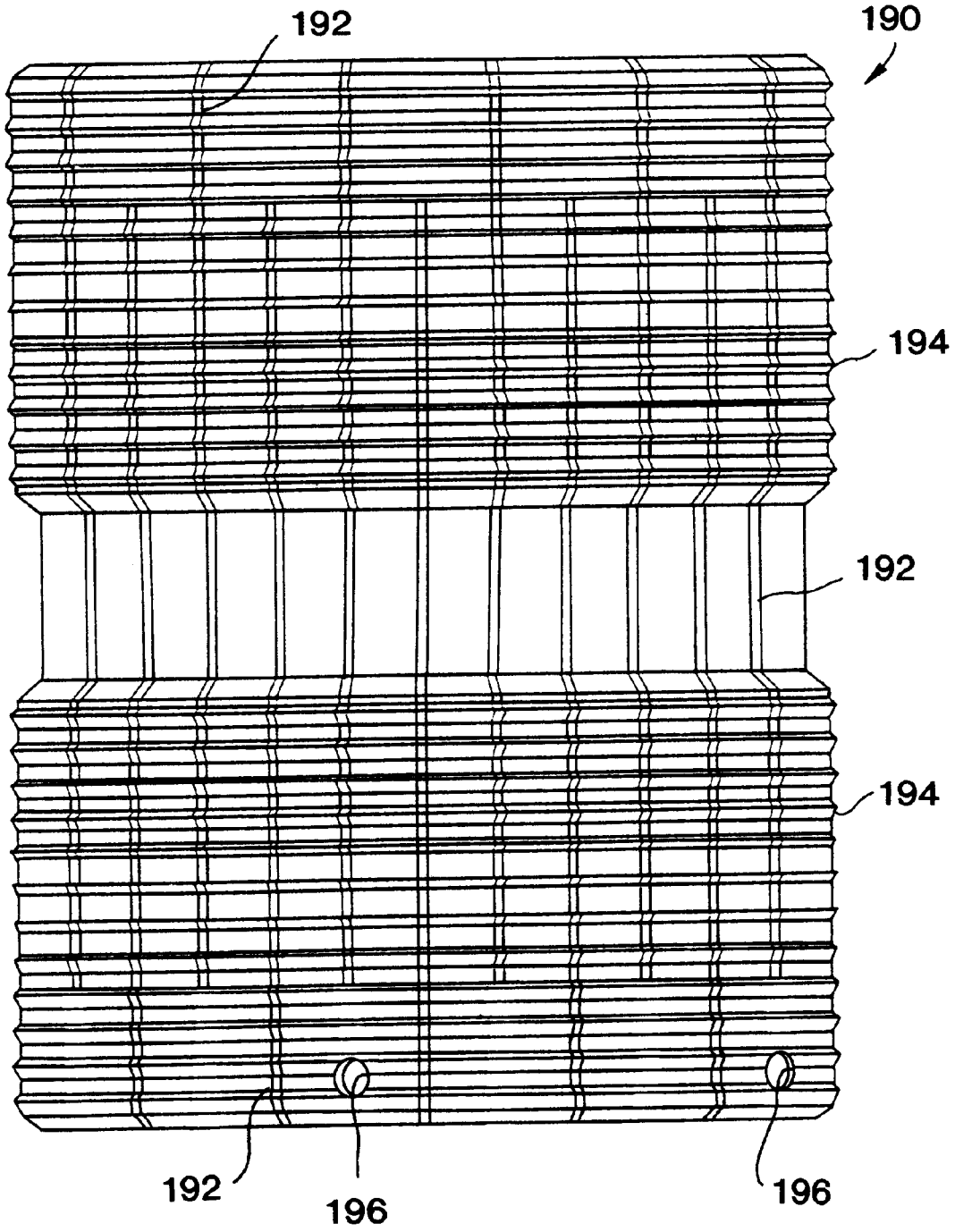
FIG. 6 is an elevational view of a device embodying principles of the present invention.

Referring additionally now to FIG. 6, a slip 190 embodying principles of the present invention is representatively illustrated. The slip 190 is a dual barrel slip and may be utilized for any of the slips 10, 152, 152*a* described above. The slip 190 is unique in at least one respect in that it has a series of circumferentially spaced apart slots 192 extending radially, but not completely axially, therethrough. The slots 192 alternate axial directions (i.e., the axial end of the slip from which they extend) circumferentially about the slip 190.

The slots 192 are formed in the slip 190 sufficiently thin so support of debris barriers thereacross is enhanced. It is preferred that the slots 192 have a thickness or width of approximately 0.020 to 0.060 inch, and that the slots be formed by water jet cutting, although other slot widths and methods of cutting may be utilized without departing from the principles of the present invention.

To produce the slip 190, it is preferred that the slip first be formed in a tubular shape, with gripping structures, teeth, or serrations 194 formed externally thereon. Openings 196 and/or other features, other than the slots 192, may also be formed on the slip 190 at this time. The slip 190 is then heat treated as desired to produce, for example, a desired strength, hardness, etc. of the slip. Then, the slots 192 are formed using conventional water jet cutting techniques. Other methods of producing the slip 190 may be utilized without departing from the principles of the present invention.

The above described method of producing the slip 190 removes less material in forming the slots 192 than does conventional milling methods. As a result, the slip tensile strength is increased, more slots may be used for a given slip diameter, thereby increasing the flexibility of the slip (i.e., decreasing its resistance to radial expansion), enabling the slip to be shortened, and producing cost savings in other components of an anchoring device on which the slip is utilized. Note that the slip 152*a* shown in FIGS. 5A&B is produced by the above described method of producing the slip 190, resulting in a shorter slip, mandrel 172*a* and wedges 156*a*, 158*a* as compared to the slip 152 produced by conventional milling techniques and its associated mandrel 172 and wedges 156, 158 shown in FIGS. 4A&B.

Figure 7:
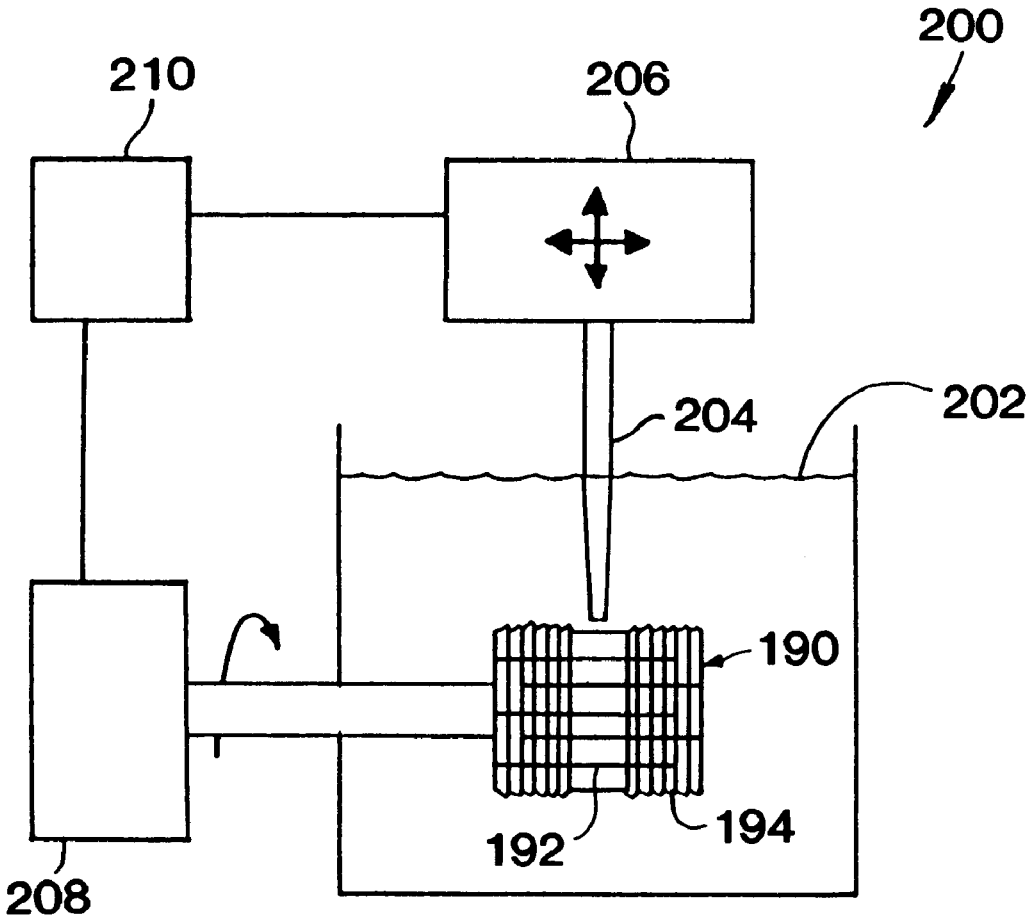
FIG. 7 is a schematic view of a method of producing a slip, the method embodying principles of the present invention.

Referring additionally now to FIG. 7, a method 200 of producing a slip embodying principles of the present invention is representatively and schematically illustrated. The method 200 is depicted in FIG. 7 and described herein as being used in producing the slip 190, however, it is to be clearly understood that other slips and other types of slips may be produced by the method, without departing from the principles of the present invention.

In the method 200, it is preferred that the slip 190 first be formed in a tubular shape, with gripping structures, teeth, or serrations 194 formed 4i externally thereon. Openings 196 and/or other features, other than the slots 192, may also be formed on the slip 190 at this time. The slip 190 is then heat treated as desired to produce, for example, a desired strength, hardness, etc. of the slip.

The slip 190 is then immersed in a liquid 202, such as water, the liquid being in intimate contact with the slip. In this manner, the liquid 202 forms a heat sink for the slip 190 so that, when the slots 192 are cut in the slip, minimal change in the metallurgical properties of the slip is experienced. Thus, the slots 192 may be cut in the slip 190 without appreciably affecting the strength, hardness, toughness, etc. of the slip.

The slots 192 are cut using a conventional flame or plasma jet cutting torch 204 which is displaced linearly by a conventional translational displacement device 206 of the type used in CNC machine tools. The displacement device 206 displaces the torch 204 both horizontally and vertically (although not necessarily at the same time) as representatively illustrated in FIG. 7, but it is to be clearly understood that separate displacement devices may be utilized for displacement in different directions, the torch may be otherwise displaced, for example, in other directions, by the displacement device, the slip 190 may be displaced instead of displacing the torch, etc., without departing from the principles of the present invention.

The slip 190 is engaged with a rotational displacement device 208, which rotates the slip relative to the torch 204. The slip 190 is engaged with the device 208, for example, by use of a chuck which grips the slip, etc. In this manner, the torch 204 may be rotationally aligned with each of the series of slots 192. For example, the torch 204 may be aligned with one desired slot 192, the slot cut by the torch, and then the slip rotated by the device 208, so that the torch may be aligned with another desired slot and cut the slot, etc., thereby incrementally progressing rotationally about the slip, until all of the slots have been cut in the slip. However, it is to be clearly understood that the slots 192 may be otherwise cut by the torch 204, for example, by rotating the torch about the slip, etc., without departing from the principles of the present invention.

Displacement of the slip 190 and torch 204 relative to each other by the devices 206, 208 is controlled by a conventional controller 210, which may be of the type used in conventional CNC machine tools. For example, the controller 210 may be programmed to cause the device 206 to displace the torch 204 relative to the slip 190 so that a first slot 192 is cut in the slip, cause the device 206 to displace the torch away from the slip, cause the device 208 to rotate the slip relative to the torch and thereby align the torch with a second desired slot, cause the device 206 to displace the torch into close proximity with the slip, cause the device 206 to displace the torch relative to the slip so that the second slot is cut in the slip, etc. However, it is not necessary for the controller 210 to be programmed in this manner, nor for the controller to be used at all, in the method 200. For example, the displacement devices 206, 208 could be manually operated.

Note that the method described above for water jet cutting of the slots 192 in the slip 190 may be performed using the displacement devices 206, 208 and controller 210, similar to the method 200, except that immersion of the slip in the liquid 202 may not be utilized, and the torch 204 would instead be a water jet cutting device. Additionally, note that it is not necessary in the water jet, flame or plasma jet slot cutting methods described above for the slip 190 to be heat treated prior to cutting the slots 192, since the slip may be heat treated after the slots are cut, or not at all. Other methods of cutting the slots 192 may be utilized as well, without departing from the principles of the present invention.

Of course, it would be obvious to a person of ordinary skill in the art to make modifications, substitutions, additions, deletions, substitutions, and other changes to the exemplary embodiment of the present invention described above, and such changes are contemplated by the principles of the present invention. For example, the slip 152, 152*a* or 190 may be other than a dual barrel slip, the debris barriers 160, 162 may be otherwise configured and/or positioned on the packer 150, other mechanisms may be employed to deploy the debris barriers, etc. Accordingly, the foregoing detailed description is to be clearly understood as being given by way of illustration and example only, the spirit and scope of the present invention being limited solely by the appended claims.

What is claimed is:

1. Apparatus operatively positionable within a subterranean well, the apparatus comprising:

a generally tubular mandrel;

a slip carried on the mandrel;

first and second circumferential debris barriers disposed relative to the slip, the first and second debris barriers being radially outwardly extended when the slip is radially outwardly extended relative to the mandrel; and first and second wedge members carried on the mandrel, at least one of the wedge members displacing axially relative to the slip when the slip is radially outwardly extended relative to the mandrel, wherein at least one of the first and second debris barriers is disposed on an outer side surface of one of the first and second wedge members, and wherein the outer side surface is laterally inclined, the one of the first and second debris barriers being disposed at least partially in a recess formed on the inclined outer side surface.

2. Apparatus operatively positionable within a subterranean well, the apparatus comprising:

a generally tubular mandrel;

a slip carried on the mandrel;

first and second circumferential debris barriers disposed relative to the slip, the first and second debris barriers being radially outwardly extended when the slip is radially outwardly extended relative to the mandrel; and first and second wedge members carried on the mandrel, at least one of the wedge members displacing axially relative to the slip when the slip is radially outwardly extended relative to the mandrel, wherein the slip engages the first and second debris barriers and axially displaces each of the debris barriers relative to generally conical outer side surfaces of corresponding ones of the first and second wedge members when the slip is radially outwardly extended relative to the mandrel.

3. Apparatus operatively positionable within a subterranean well, the apparatus comprising:

first and second circumferential debris barriers; and a slip positioned substantially axially between the first and second debris barriers, wherein the first debris barrier is disposed at least partially in a first recess, and wherein the first debris barrier is displaced completely out of the first recess when the slip is radially outwardly extended.

4. Apparatus operatively positionable within a subterranean well, the apparatus comprising:

first and second circumferential debris barriers; and a slip positioned substantially axially between the first and second debris barriers, wherein the first debris barrier is disposed at least partially in a first recess, wherein a peripheral edge surface of the first recess opposite the slip has a first angle with respect to a longitudinal axis of the apparatus, the first angle being laterally sloped, nonzero and nonperpendicular, the slip pushing the first debris barrier across the angled surface when the slip is radially outwardly extended, and wherein the second debris barrier is disposed at least partially in a second recess, and wherein a peripheral edge surface of the second recess opposite the slip has a second angle with respect to the axis of the apparatus, the slip pushing the second debris barrier across the angled surface of the second recess when the slip is radially outwardly extended.

5. The apparatus according to claim 4, wherein the second angle is different from the first angle.

6. The apparatus according to claim 5, wherein the slip has first and second opposite end portions, and wherein the difference between the first and second angles causes the first slip end portion to push the first debris barrier out of the first recess before the second slip end portion pushes the second debris barrier out of the second recess when the slip is radially outwardly extended.

7. The apparatus according to claim 5, wherein the slip has first and second opposite end portions, and wherein the difference between the first and second angles causes the first end portion to radially outwardly extend before the second end portion radially outwardly extends when the slip is radially outwardly extended.

8. Apparatus operatively positionable within a subterranean well, the apparatus comprising:

first and second circumferential debris barriers; and a slip positioned substantially axially between the first and second debris barriers, wherein the slip pushes each of the first and second debris barriers across a laterally sloped surface, thereby radially outwardly extending the first and second debris barriers when the slip is radially outwardly extended.

9. Apparatus operatively positionable within a subterranean well, the apparatus comprising:

first and second circumferential debris barriers; and a slip positioned substantially axially between the first and second debris barriers, wherein the slip includes a series of circumferentially spaced apart slots, and wherein the slots are sufficiently thin such that at least one of the first and second debris barriers is supportable by the slip across the slots.

10. The apparatus according to claim 9, wherein the slots are water jet cut through the slip.

11. Apparatus operatively positionable within a subterranean well, the apparatus comprising:

first and second circumferential debris barriers;

a slip positioned substantially axially between the first and second debris barriers; and first and second wedge members, the slip extending radially outward in response to at least one of the first and second wedge members being displaced relative to the other of the wedge members, wherein the first wedge member has a first circumferential recess formed on a first outer surface thereof, the first debris barrier being disposed at least partially in the first recess, and wherein the slip pushes the first debris barrier out of the first recess when at least one of the first and second wedge members is displaced relative to the other of the wedge members.

12. The apparatus according to claim 11, wherein the second wedge member has a second circumferential recess formed on a second outer surface thereof, the second debris barrier being disposed at least partially in the second recess, and wherein the slip pushes the second debris barrier out of the second recess when at least one of the first and second wedge members is displaced relative to the other of the wedge members.

13. The apparatus according to claim 12, wherein at least one of the first and second recesses has a sloped peripheral surface, the slip pushing the corresponding one of the first and second debris barriers across the sloped surface when at least one of the first and second wedge members is displaced relative to the other of the wedge members.

14. The apparatus according to claim 12, wherein each of the first and second recesses has a sloped peripheral surface, the slip pushing each of the first and second debris barriers across the sloped surface of the corresponding recess when at least one of the first and second wedge members is displaced relative to the other of the wedge members.

15. The apparatus according to claim 14, wherein the slip pushes the first debris barrier across the sloped surface of the first recess before the slip pushes the second debris barrier across the sloped surface of the second recess when at least one of the first and second wedge members is displaced relative to the other of the wedge members.

16. Apparatus operatively positionable within a subterranean well, the apparatus comprising:

first and second circumferential debris barriers; and a slip positioned substantially axially between the first and second debris barriers, wherein the first and second debris barriers are carried on the slip.

17. The apparatus according to claim 16, wherein each of the first and second debris barriers is carried in a recess formed externally on the slip.

18. A method of anchoring an apparatus within a tubular structure disposed within a subterranean well, the method comprising the steps of:

providing the apparatus including a generally tubular mandrel, a slip carried on the mandrel, and first and second circumferential debris barriers disposed relative to the slip; and radially outwardly expanding the first and second debris barriers into engagement with the tubular structure by engaging the slip with the first and second debris barriers, the slip displacing the debris barriers relative to generally conical outer side surfaces of the first and second wedge members, while simultaneously radially outwardly extending the slip into gripping engagement with the tubular structure.

19. The method according to claim 18, wherein in the providing step, the apparatus includes first and second wedge members, and wherein the radially outwardly expanding step is performed by displacing at least one of the wedge members axially relative to the mandrel.

20. The method according to claim 19, further comprising the step of disposing the first debris barrier on an outer side surface of the first wedge member.

21. The method according to claim 20, wherein in the first debris barrier disposing step, the first debris barrier is positioned on a laterally inclined portion of the first wedge member outer side surface.

22. A method of anchoring an apparatus within a tubular structure disposed within a subterranean well, the method comprising the steps of:

providing a slip; and radially outwardly extending first and second debris barriers into engagement with the tubular structure, the slip engaging and pushing the first and second debris barriers, and the slip being disposed substantially between the debris barriers.

23. The method according to claim 22, wherein the extending step is performed in response to radially outwardly extending the slip into gripping engagement with the tubular structure.

24. The method according to claim 22, wherein the slip has first and second opposite ends, and further comprising the step of radially outwardly extending the first opposite end before radially outwardly extending the second opposite end.

25. The method according to claim 22, wherein the extending step further comprises radially outwardly extending the first debris barrier before radially outwardly extending the second debris barrier.

26. The method according to claim 22, wherein the pushing step further comprises pushing the first debris barrier out of a first recess, and pushing the second debris barrier out of a second recess.

27. The method according to claim 26, wherein the first debris barrier pushing step is performed before the second debris barrier pushing step.

28. The method according to claim 22, wherein the extending step further includes radially outwardly extending the slip into gripping engagement with the tubular structure.

29. The method according to claim 28, wherein at least one of the first and second debris barriers is radially outwardly extended at a rate greater than that at which the slip is radially outwardly extended.

30. The method according to claim 28, wherein at least one of the first and second debris barriers is engaged with the tubular structure before the slip is grippingly engaged with the tubular structure.

* * * * *